US005575340A

United States Patent [19]

Williams

[11] Patent Number: 5,575,340

[45] Date of Patent: Nov. 19, 1996

[54] METHOD FOR EXTINGUISHING SHIP CONTAINER FIRES

[76] Inventor: Dwight Williams, P.O. Box 1359, Mauriceville, Tex. 77626

[21] Appl. No.: 281,475

[22] Filed: Jul. 27, 1994

[51] Int. Cl.[6] ..... A62C 3/00

[52] U.S. Cl. ..... 169/46; 169/54

[58] Field of Search ..... 169/43, 46, 47, 169/54, 62, 70; 220/88.1, 88.3

[56] References Cited

U.S. PATENT DOCUMENTS

| | | | |
|---|---|---|---|
| 4,088,193 | 5/1978 | Colgate | 169/62 X |
| 4,197,914 | 4/1980 | Grey | 169/70 X |
| 4,676,319 | 6/1987 | Cuthbertson | 169/70 |
| 5,368,106 | 11/1994 | Coughlin | 169/70 |

*Primary Examiner*—Andrew C. Pike
*Attorney, Agent, or Firm*—Sue Z. Shaper; Butler & Binion, L.L.P.

[57] ABSTRACT

The present invention provides a method for extinguishing ship container fires by introducing an inert gas into the container to drive combustible gas such as air out of the container. The method includes the steps of drilling at least one hole in a wall of a ship container, attaching a toggle bolt to one end of a wall fitting, sliding a gasket over the other end of the wall fitting, inserting the wall fitting into the drilled hole such that the toggle bolt expands against the inside wall of the container, sealingly attaching the wall fitting around the drilled hole, attaching tubing to the fitting to establish fluid communication between the tubing and the inside of the container, coupling a portion of the tubing to a source of inert gas, and controlling the communication of the inert gas through the tubing and fitting to drive combustible gas out of the container. In another embodiment, a second hole may be drilled in the container and the second hole fitted with a similar device to facilitate the steps of sampling and testing exhaust vapors within the container.

17 Claims, 3 Drawing Sheets

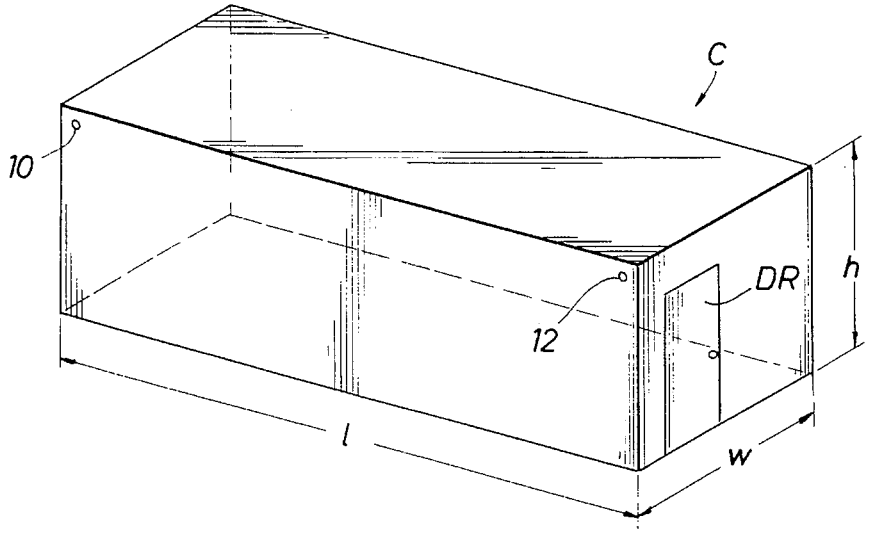
FIG.1
FIG.2
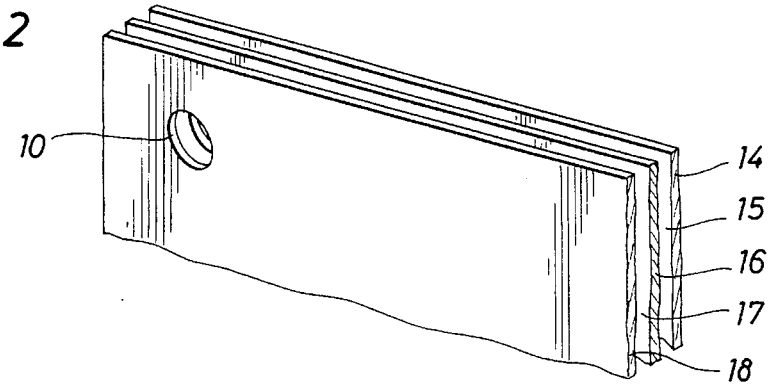
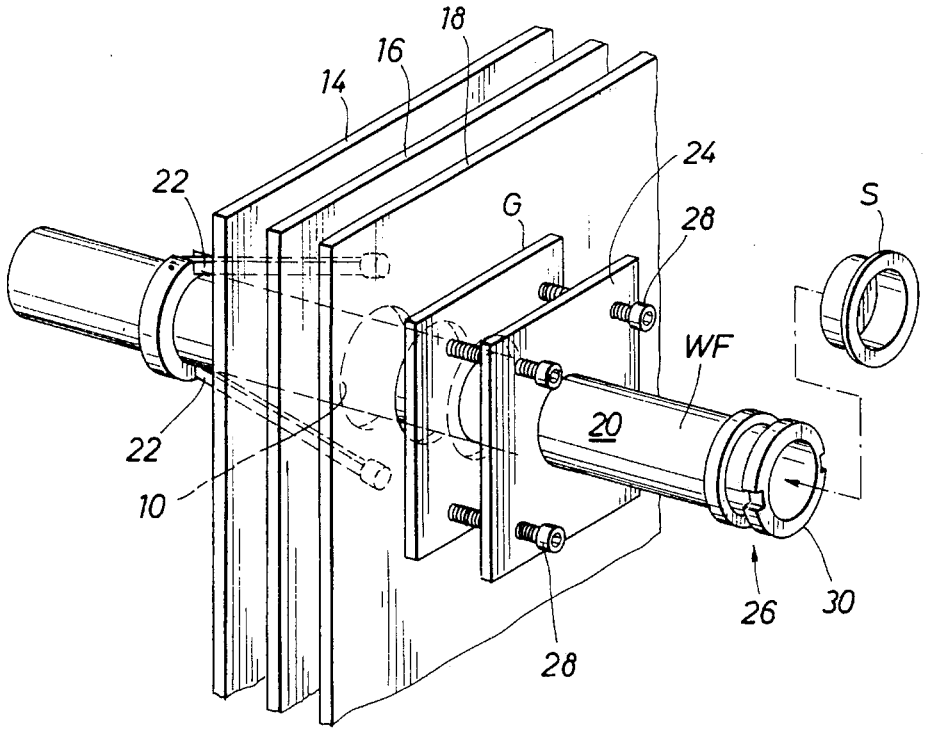
FIG.3

FIG. 4
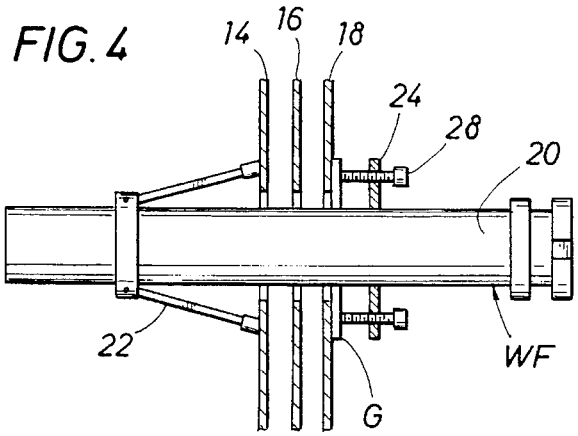
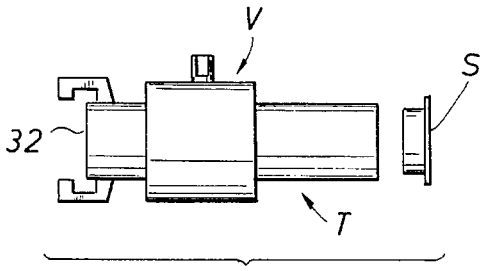
FIG. 6
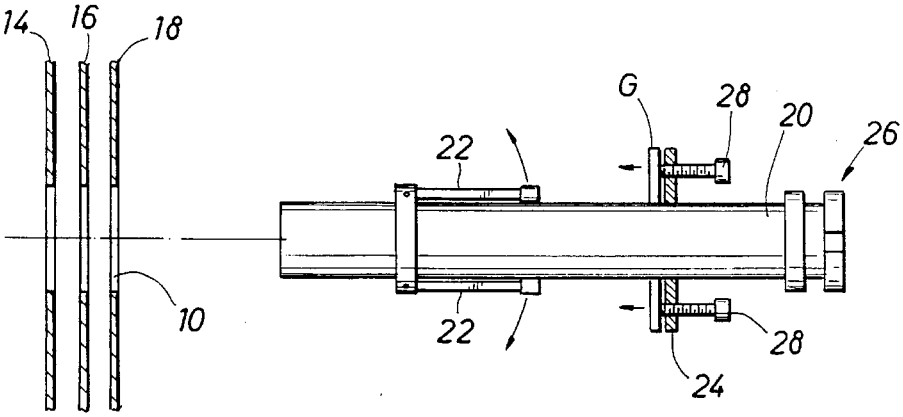
FIG. 5
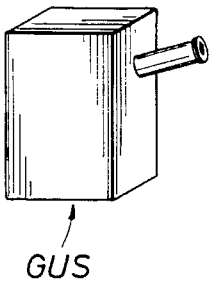
FIG. 7
FIG. 9
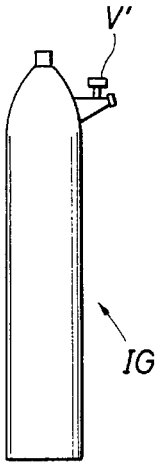
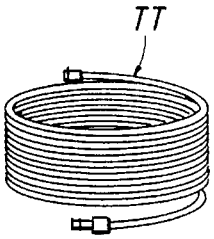
FIG. 8

FIG. 10
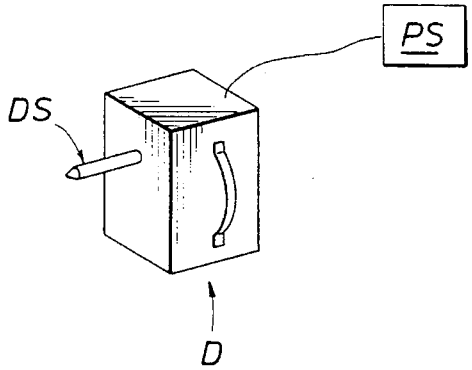
FIG. 11
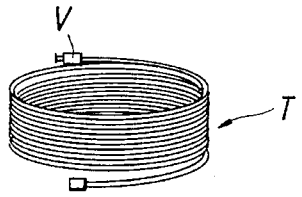
FIG. 12
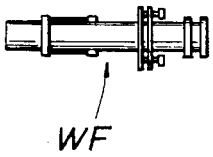
FIG. 13
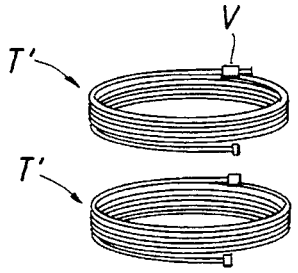
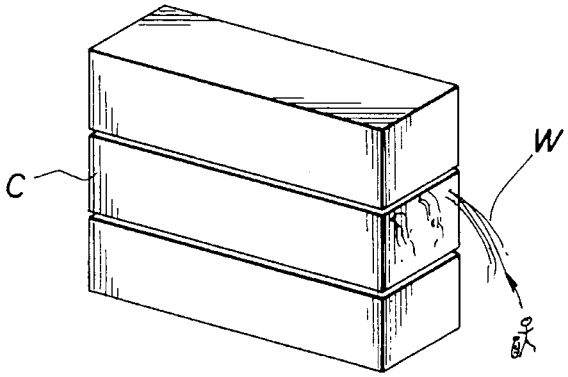
FIG. 14
FIG. 15
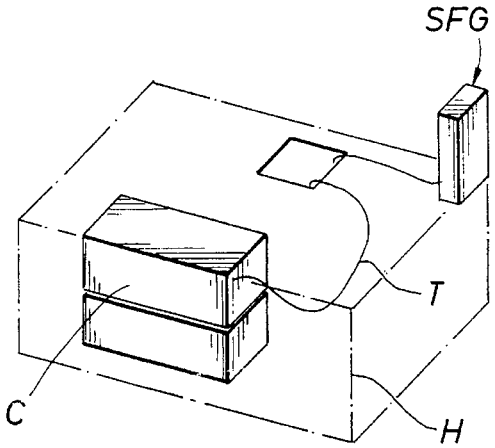

METHOD FOR EXTINGUISHING SHIP CONTAINER FIRES

BACKGROUND OF INVENTION

1. Field of Invention

This invention relates to method and apparatus for extinguishing fires in ship containers and includes a kit for use in extinguishing fires.

2. Background of Invention

Standard ship containers are approximately 40 feet long, 8 feet wide and 8½ feet tall. They are constructed of steel or aluminum and have walls approximately 4 to 5 inches thick. Typically, a container wall is comprised of a 1/16-inch sheet of steel or a 1/8-inch sheet of aluminum covering an approximate 1/8-inch sheet of wood, with another 1/16-inch sheet of steel or 1/8-inch sheet of aluminum on the outside. Since a wall runs approximately 4 to 5 inches thick, air is sandwiched between the layers. The containers may also be constructed of fiberglass. A single door will exist on one side or end wall of the container.

Typically, ship containers are packed tightly, leaving not more than 1,000 square feet of air space. It is standard for the top approximately 6 inches to be left clear for air.

All combinations and types of goods may be found juxtaposed inside of one container, including combustible goods, flammable goods, and highly flammable goods. Consumer electronic goods, of all sorts are commonly shipped by container.

Containers are stacked on a ship eight deep in the holes and five high on the decks. Attachment means exist to hold the containers together and to keep them from sliding over the flooring or decking. It is standard practice for at least one side of every container to be left exposed. This side is often, however, not the side having the single door. A small space is maintained among the stacks in the holes and on the decks to permit human passage.

With increasing frequency, the contents of a container catch fire, often during transit. When this happens, current practice dictates, for a container in transit, that the ship turn immediately to the nearest port. In port, either a floating barge with a derrick or a gantry crane is hired to unload the containers in order to remove the offender. Perhaps at this point multiple containers are on fire.

It should be noted that a ship also carries numerous bottles of carbon dioxide. When a hole has a fire the hole can be flooded with the gas to inhibit the spread of the fire until other measures can be taken.

The current practice and procedure followed upon the occasion of a container fire in transit involves significant loss of time and money. There is the expense of portage and the hiring of the derrick or gantry. There is the delay in the arrival of the other merchandise on board and the loss of the effective utilization of the transport vessel. There is the further possible loss or spoilage of merchandise surrounding the original burning container, the loss being heightened by the extent of the time of exposure.

SUMMARY OF THE INVENTION

The present invention comprises an improved method and apparatus for treating and dealing with container fires. It is particularly applicable to containers onboard ship. It also has application to containers in transit in general. By utilizing the improved apparatus and method, it is possible to extinguish a fire quickly, obviating any need to turn to the nearest port. This can produce a significant reduction in the spoilage of adjacent merchandise and in the loss of the effective use of the vessel.

The method comprises accessing the burning container and drilling at least one hole in its wall, preferably two. The hole or holes probably would be drilled either in the top of the container or along the top of the container's wall, adjacent the customary air space. The location may be a function of access. A suitable fitting is provided to attach around the hole to form an airtight seal. To this fitting tubing, or a hose, is attached. The tubing, communicating with the air space inside the container through the fitting, is attached to a source of inert gas, probably carbon dioxide, ship flue gas, or engine exhaust gas. Valves associated with the source of the gas and/or on the tubing permit controlled flooding of the inside of the container with a noncombustible fluid.

In a preferred embodiment a second, sampling tubing or hose is attached to a second airtight fitting around a second hole drilled in the wall of the container. Alternately, sampling may be accomplished through the first hole and first tubing. The sampling tubing, communicating with the air space inside the container, is connected to a means for sampling and measuring exhaust vapors or the atmosphere inside the container. Testing the exhaust or atmosphere for levels of oxygen and/or carbon monoxide permits ascertaining whether the atmosphere inside the container can continue to sustain combustion. Such a test could reliably indicate whether all combustion has ceased, together with its associated generation of heat, and whether it was thus safe to proceed to the next scheduled port.

BRIEF DESCRIPTION OF THE DRAWINGS

FIG. 1 is an illustrative elevational view of a container.

FIG. 2 illustrates a detail of a wall of a container of the type of FIG. 1.

FIG. 3 illustrates a wall fitting secured in a container wall.

FIG. 4 presents an alternate illustration of a wall fitting secured in a container wall.

FIG. 5 illustrates a wall fitting prior to being secured in a hole in a container wall.

FIG. 6 illustrates a section of tubing having a valve.

FIG. 7 illustrates a gas measurement system used in the practice of the method of the invention.

FIG. 8 illustrates a second tubing section for sampling the atmosphere of a ship container.

FIG. 9 illustrates a source of inert gas used in the practice of the method of the invention.

FIG. 10 illustrates a drill used to insert holes in a ship container.

FIG. 11 illustrates a first tubing section for fluid communication between a ship container and an inert gas source.

FIG. 12 illustrates a wall fitting used in the practice of the method of the invention.

FIG. 13 illustrates segmented lengths of tubing used in the practice of the method of the invention.

FIG. 14 illustrates the use of water to cool the container.

FIG. 15 illustrates the use of ship flue gas to extinguish a container fire.

DETAILED DESCRIPTION OF THE PREFERRED EMBODIMENTS

FIG. 1 illustrates a ship container C having length l, width w, and height h. In standard ship containers the length l is usually 40 feet; the width w is usually 8 feet; and the height h is approximately 8½ feet. Container C of FIG. 1 is shown having two holes in one side wall, hole 10 and hole 12, as well as door DR in an end wall. Holes 10 and 12 are illustrated as being placed close to the top of container C. As previously mentioned, container C may be tightly packed with goods. Air space, however, at least a few inches, is usually left at the top of every container C. Holes 10 and 12 illustrate holes drilled in accordance with the preferred teaching of this invention. It is to be understood that the location of the holes may be dictated by access.

FIG. 2 illustrates in more detail the typical construction of a wall of a ship-type container. FIG. 2 shows hole 10 placed through the wall of container C and illustrates that the wall is comprised of a sandwich of three plys. The outer ply 18 and inner ply 14 usually comprise 1/16-inch steel sheet or ⅛-inch aluminum sheet. Inner ply 16 usually comprises a sheet of plywood. Spaces 15 and 17 between the plys of the wall of the container will contain air. The typical total width of a container wall is 4 inches to 5 inches. Of course, the walls could be of fiberglass and their width could vary. Such changes would not affect the nature of the invention. It might require an adjustment to the dimensions of the apparatus.

FIG. 3 illustrates one embodiment of a tubular wall fitting WF attached in hole 10 of an illustrative wall of a container. In the example of FIG. 3, tubular wall fitting WF is comprised of a body of pipe 20. The hole 10 is approximately 4 to 5 inches long. Pipe 20 should be at least six inches long. Preferably, hole 10 has been drilled with an approximate diameter of 1½ inches. Such a hole could be drilled using the power drill D of FIG. 10, for instance, where the drill stem DS of FIG. 10 comprises a 1½ inch drill stem. The outside diameter of pipe 20 of tubular wall fitting WF might be 1 inch to 1¼ inches.

Pipe 20 of wall fitting WF, as well as its attachments, must be capable of sustaining high temperatures, such as up to 500° F.

As perhaps more conveniently illustrated in FIG. 5, tubular wall fitting WF is comprised of pipe 20 having a flexible toggle bolt type arrangement 22 attached at one end, illustrated as comprising arms that pivot around a collar attached to the pipe, the arms being biased outwardly from the collar. Gasket G of a suitable sealing material closely fits and sealingly slides over pipe 20. Gasket G seals the opening between the fitting and the wall. A plate 24 is illustrated fixed to pipe 20, at the end opposite to the toggle bolt arrangement containing bolts 28. Bolts 28, screwing through plate 24, force gasket G to slide down the surface of pipe 20 and to press tightly against the outside wall. A plate to distribute the pressure might be located at the back side of gasket G. Other equivalent means of securing a gasket type device to seal between the pipe and the wall around the hole could be devised by those of skill in the art.

In operation, wall fitting WF is attached to a hole 10 in container C by sliding the toggle bolt end of pipe 20 through hole 10 with the bolt arms compressed against the bias. After sliding through the hole the arms open under their outward bias pressure. Such pressure could be provided by springs located around the hinge where the bolt arm connects with the bolt collar. Pipe 20 is pulled back towards the outside of the container until the arms of toggle bolt arrangement 22 fit securely against the inside of the container wall. Bolts 28 are then screwed forward through plate 24 to force gasket G and any stiffening material on its back side to slide down pipe 20 to form a tight seal between and around pipe 20 and hole 10 in wall section 18 of the container. In such a manner the fitting has been efficiently and effectively placed through hole 10 and sealed airtight, which fitting permits controlled fluid communication between the inside and the outside of the container. Other equivalent means of securing an airtight attachment of a fitting could be devised by those in the art without departing from the spirit of this invention.

Tubing T, as illustrated by FIG. 6, is adapted to attach at its end 32 to end 26 of tubular wall fitting WF. However, while a wall fitting is in the process of being attached around a hole in a container wall, a stopper such as stopper S of FIG. 3 might be placed at the end portion 30 of wall fitting WF to prevent feeding oxygen to the inside of container C during the installation of the wall fitting. Stopper S would be removed and tubing T attached to the tubular fitting at end 30 subsequent to the installation of the fitting. Valve V, shown in FIG. 6 located on a section of tubing T, might also be used to control and limit the communication of fluids through tubing T and wall fitting WF during the attachment phase for the fitting. In this case, wall fitting WF would be installed with tubing T, or a section of tubing T, already attached to the fitting. Valve V, located on tubing T, would be used to inhibit feeding oxygen to the interior of container C during the attachment phase. A similar valve V located at the other end of the tubing might be useful to provide for the control of flows from both ends of tube T.

It is conceivable that the present invention could be practiced where the tubing itself comes with alternate means of sealing attachment at one end. Such means of attachment could comprise a glue or gel that would quickly set and hold fast under pressure and heat. Various pressure type fittings on the end of the tube could also be attempted, utilizing for instance, the pressure creating capacities of fitting together a conical shape with a cylindrical shape. A tube ending that compressed radially upon insertion in one direction and that expanded radially upon pull in the opposite direction would also suffice. Such devices, although not common, could comprise a suitable "wall fitting" measure and could be designed by one of ordinary skill in the art. They are intended to be included within the scope of the present invention.

FIG. 7–13 show the elements of an apparatus kit useful to practice the present invention. The elements of the apparatus kit include drill D (FIG. 10). Drill D can be any commercially suitable power drill capable of drilling a ½-inch to a 2 inch hole in typical ship container walls, such as those containing 1/16 inch steel sheet. Drill D will contain means for connecting to power source PS. Depending upon the vessel, drill D might be powered by air, by water, by electricity or by other means.

A kit for practicing the present invention will contain at least one length, and preferably many lengths, of tubing T (FIG. 11). Tubing T should be at least 25 feet long. One hundred feet or more of tubing would be preferable. A second section of tubing TT (FIG. 8) might also be present for use for attachment to a second hole 12, for instance, also drilled in the same container. If two holes are drilled and two sections of tubing are attached to two separate wall fittings, one hole could be used to fill the container with inert gas, such as carbon dioxide, while the other tubing could be used to permit sampling of exhaust vapors, or the interior atmosphere. Alternately, the same tubing could be used in sequence both to fill the container with gas and to sample vapors.

Sampling could be performed with such standard equipment as a Drager gas measurement system (FIG. 7) distributed by National Drager, Inc., of Pittsburgh, Pa. Such sampling apparatus GMS could be contained in the kit. Gas measurement system GMS is presumed to have a suitable means for attaching to tubing in order to receive and sample exhaust or interior atmospheric vapors from tubing T or TT. Such exhaust vapors might be sampled for their content, or percent content, of oxygen and/or of carbon monoxide. Such sampling would indicate the capacity of the interior of the container to sustain combustion.

Tubing T might actually be comprised of a plurality of segmented lengths of tubing T' (FIG. 13). Such segmented lengths T' would have means for attachment one to the other. At least one such segmented length, and possibly several, would preferably contain a valve V. A Valve V might be contained at both ends of a segment of tubing. In FIG. 9, container IG illustrates a source for inert gas. Container IG might be a common shipboard bottle of carbon dioxide, for instance. Alternately, it might be possible to use shipboard flue gas SFG as the inert gas, or engine exhaust gas. Thus, "container" IG might have various shapes. Typically, container IG would contain a fitting to be attached to tubing and would have its own valving means V'.

In operation, a container on fire is first detected. The container might be on a ship, the deck or in the hold H of on a truck, or at a dock. The container is accessed and one or possibly two holes, depending upon the situation, are drilled in the container wall, preferably in the air space at the upper end of the container. A wall fitting (FIG. 12) is sealingly attached around the hole in order to permit a length of tubing to communicate through the fitting with the atmosphere inside the container without otherwise leaking air. The wall fitting might comprise a pipe segment partially inserted through the hole and secured against the inside wall of the container by pulling against a toggle bolt arrangement. The pipe is sealed against the outside wall of the container by a gasket slid down the pipe and pressed against the outside wall through use of some pressure means affixed to the length of pipe. Tubing is then attached to the pipe. Alternatively, the tubing could have been attached to the fitting prior to the fitting's insertion. The tubing preferably comprises temperature resistant high pressure rubber braided hose. The tubing might come in several short lengths to be attached together as necessary. If two holes are drilled, two wall fittings are sealingly attached with two sections of tubing attached to two wall fittings. During the attaching process, the wall fitting might have a stopper set to minimize feeding oxygen to the fire. Alternately, the fitting could be set in the hole while connected to a segment of tubing. The tubing could have valve or stopper means to inhibit fluid communication during installation.

At least one tubing is connected to a source of inert gas such as a bottle of carbon dioxide or shipboard flue gas SFG or the exhaust of an engine. FIG. 15 depicts one possible connection in which container C stored in the hold H of a ship is in fluid communication by way of tubing T with ship flue gas SFG. A valve or valves are opened and the container is flooded with the inert gas. The container may also be covered with water W to cool it during this stage as is shown in FIG. 14.

A means for sampling exhaust vapors or interior atmosphere through tubing is attached, either to the one tubing attached to the container or preferably to a second tubing fixed to a second hole in the container. Exhaust vapors are sampled and tested through apparatus, such as a Drager measurement system. The container is deemed no longer on fire when the exhaust vapors or interior atmosphere indicate that the level of oxygen and/or carbon monoxide is sufficiently low that combustion can no longer be sustained.

The foregoing disclosure and description of the invention are illustrative and explanatory thereof. Various changes in the size, shape, and materials, in the details of the illustrated construction, as well as the interchange of known functional equivalents, may be made without departing from the spirit of the invention.

What is claimed is:

1. A method for extinguishing ship container fires in a ship container having a top and at least one side wall to define an inside of the container, the inside of the container further defining a container customary air space within the container adjacent the top, the method comprising:

drilling a first hole in the wall of the ship container;

sealingly attaching a wall fitting around the hole including attaching means for resisting retraction of the fitting through the hole, and pressuring sealing means between the fitting and the hole;

attaching tubing to the wall fitting to establish fluid communication through the tubing and the fitting with the inside of the container;

coupling a portion of the tubing to a source of inert gas; and controlling the fluid communication of the inert gas through the tubing and the fitting to the inside of the container.

2. The method of claim 1 wherein the sealingly attaching includes attaching a wall fitting constructed of material to withstand heat of at least 500° F. within an approximately 4-inch to 5-inch thick wall.

3. The method of claim 1 wherein the controlling includes controlling the fluid communication through the tubing with a stopper.

4. The method of claim 1 wherein the controlling includes controlling the fluid communication through the fitting with a stopper.

5. The method of claim 1 which method further includes spraying the container with water to cool the container.

6. The method of claim 1 wherein the coupling to the source of the inert gas comprises coupling to carbon dioxide.

7. The method of claim 1 wherein the coupling to the source of the inert gas comprises coupling to ship flue gas.

8. The method of claim 1 which method further includes inhibiting the fluid communication through the wall fitting during the attaching of the fitting.

9. The method of claim 1 further comprising:

sampling an exhaust vapor through the tubing; and testing the exhaust vapor for percent content of oxygen.

10. The method of claim 9 further comprising testing the exhaust vapor for percent content of carbon monoxide.

11. The method of claim 1 wherein the drilling includes drilling at least one ½-inch hole in 1/16-inch steel; wherein the attaching the tubing includes attaching at least 25 feet of high pressure heat resistant tubing of a diameter between approximately ½ inch to 2 inches; and wherein the attaching the fitting includes attaching a heat resistant wall fitting means for securing an airtight attachment of the tubing to the at least ½-inch drilled hole and establishing the fluid communication through the heat resistant tubing and the fitting means.

12. The method of claim 1 wherein the attaching the tubing to the wall fitting is comprised of attaching together attachable tubing segments.

13. The method of claim 1 wherein the attaching the wall fitting comprises attaching a section of pipe at least 6 inches long and having an outside surface of an outside diameter of between ¼ inch to 1¾ inches.

14. The method of claim 13 wherein the means for resisting includes a toggle attached alone end of the 6-inch long pipe section and the sealing means includes a gasket having an inner diameter and an outer diameter, wherein the sealingly attaching comprises the steps of activating the toggle to engage the side wall and sealingly sliding the gasket over the outside surface of the 6-inch long pipe section.

15. The method of claim 14 which method wherein the pressuring includes pressuring the sealing means gasket along the pipe section toward the toggle.

16. The method of claim 1 wherein the drilling a first hole includes drilling a first hole proximate the container top in the container customary air space.

17. A method for extinguishing ship container fires, the method comprising:

drilling a first hole in a wall of a ship container;

sealingly attaching a wall fitting around the hole;

attaching tubing to the wall fitting to establish fluid communication through the tubing and the fitting with an inside of the container;

coupling a portion of the tubing to a source of inert gas;

controlling the fluid communication of the inert gas through the tubing and the fitting to the inside of the container;

drilling a second hole in the ship container wall;

sealingly attaching a second wall fitting around the second hole;

attaching second tubing to the second fitting to establish a second means of fluid communication with the inside of the container;

sampling exhaust vapors through the second tubing; and testing the sampled exhaust vapors.

* * * * *